US008667903B1

(12) United States Patent
Goltry

(10) Patent No.: US 8,667,903 B1
(45) Date of Patent: Mar. 11, 2014

(54) ADJUSTABLE TABLE ASSEMBLY

(76) Inventor: Kevin S. Goltry, Huntley, IL (US)

( * ) Notice: Subject to any disclaimer, the term of this patent is extended or adjusted under 35 U.S.C. 154(b) by 0 days.

(21) Appl. No.: 13/540,105

(22) Filed: Jul. 2, 2012

(51) Int. Cl.
*A47F 5/12* (2006.01)

(52) U.S. Cl.
USPC ..... 108/4; 108/132; 108/169

(58) Field of Classification Search
USPC ..... 108/4, 8, 10, 129–133, 157.1, 158.11, 108/167–170, 43; 248/118.1, 346.01
See application file for complete search history.

(56) References Cited

U.S. PATENT DOCUMENTS

| | | | | | |
|---|---|---|---|---|---|
| 874,435 | A | * | 12/1907 | Prescott | 248/397 |
| 2,035,340 | A | * | 3/1936 | Primavera | 206/431 |
| 2,535,112 | A | | 12/1950 | Woody | |
| 2,567,593 | A | * | 9/1951 | Bemis | 108/4 |
| 3,543,312 | A | | 12/1970 | Pofferi | |
| 5,497,706 | A | * | 3/1996 | Yong | 108/23 |
| 5,615,620 | A | | 4/1997 | Owen | |
| 6,044,758 | A | | 4/2000 | Drake | |
| 6,079,676 | A | * | 6/2000 | Hackett et al. | 248/118 |
| 6,523,485 | B1 | * | 2/2003 | Cipolla | 108/14 |
| 6,802,265 | B1 | | 10/2004 | Dodson et al. | |
| D514,057 | S | | 1/2006 | Borunda et al. | |
| D624,922 | S | | 10/2010 | Hui et al. | |
| D630,452 | S | * | 1/2011 | Robbins et al. | D6/406.3 |

* cited by examiner

*Primary Examiner* — Matthew Ing

(57) ABSTRACT

An adjustable table assembly provides a plurality of adjustable support surfaces positionable in a selectable configuration as desired by a user. The assembly includes a medial panel having a first side and a second side. A first slot extends into the first side of the medial panel. A first side panel is coupled to the medial panel. The first side panel is slidably inserted into the first slot whereby the first side panel is selectively extendable from the medial panel. A first side pivot hinge is coupled between the medial panel and the first side panel. Thus, the first side panel is pivotable relative to the medial panel. A plurality of legs is coupled to the medial panel.

7 Claims, 6 Drawing Sheets

ADJUSTABLE TABLE ASSEMBLY

BACKGROUND OF THE DISCLOSURE

1. Field of the Disclosure

The disclosure relates to table devices and more particularly pertains to a new table device for providing a plurality of adjustable support surfaces positionable in a selectable configuration as desired by a user.

2. Summary of the Disclosure

An embodiment of the disclosure meets the needs presented above by generally comprising a medial panel having a first side and a second side. A first slot extends into the first side of the medial panel. A first side panel is coupled to the medial panel. The first side panel is slidably inserted into the first slot whereby the first side panel is selectively extendable from the medial panel. A first side pivot hinge is coupled between the medial panel and the first side panel. Thus, the first side panel is pivotable relative to the medial panel. A plurality of legs is coupled to the medial panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
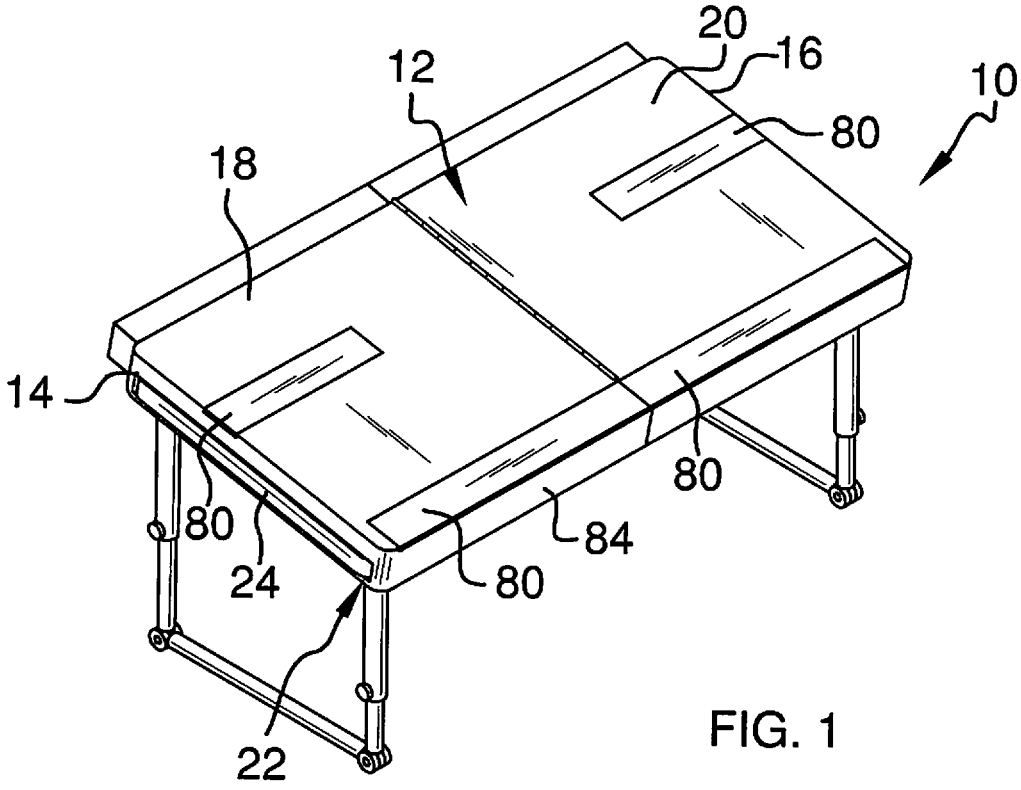
FIG. 1 is a top front side perspective view of a adjustable table assembly according to an embodiment of the disclosure.
Figure 2:
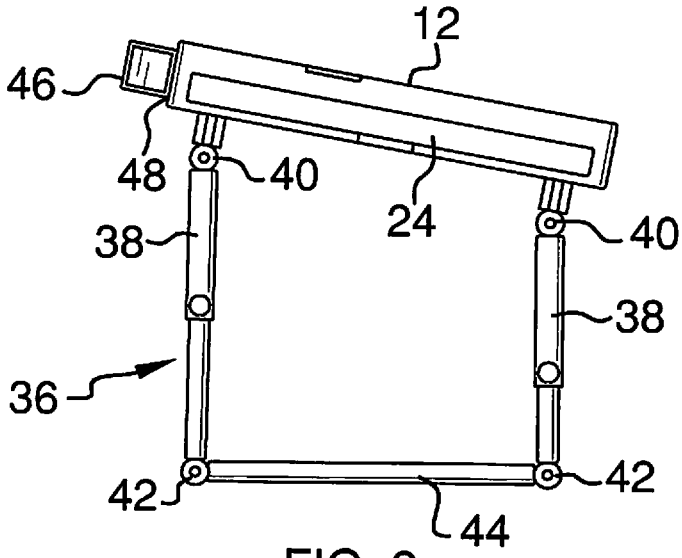
FIG. 2 is a side view of an embodiment of the disclosure.
Figure 3:
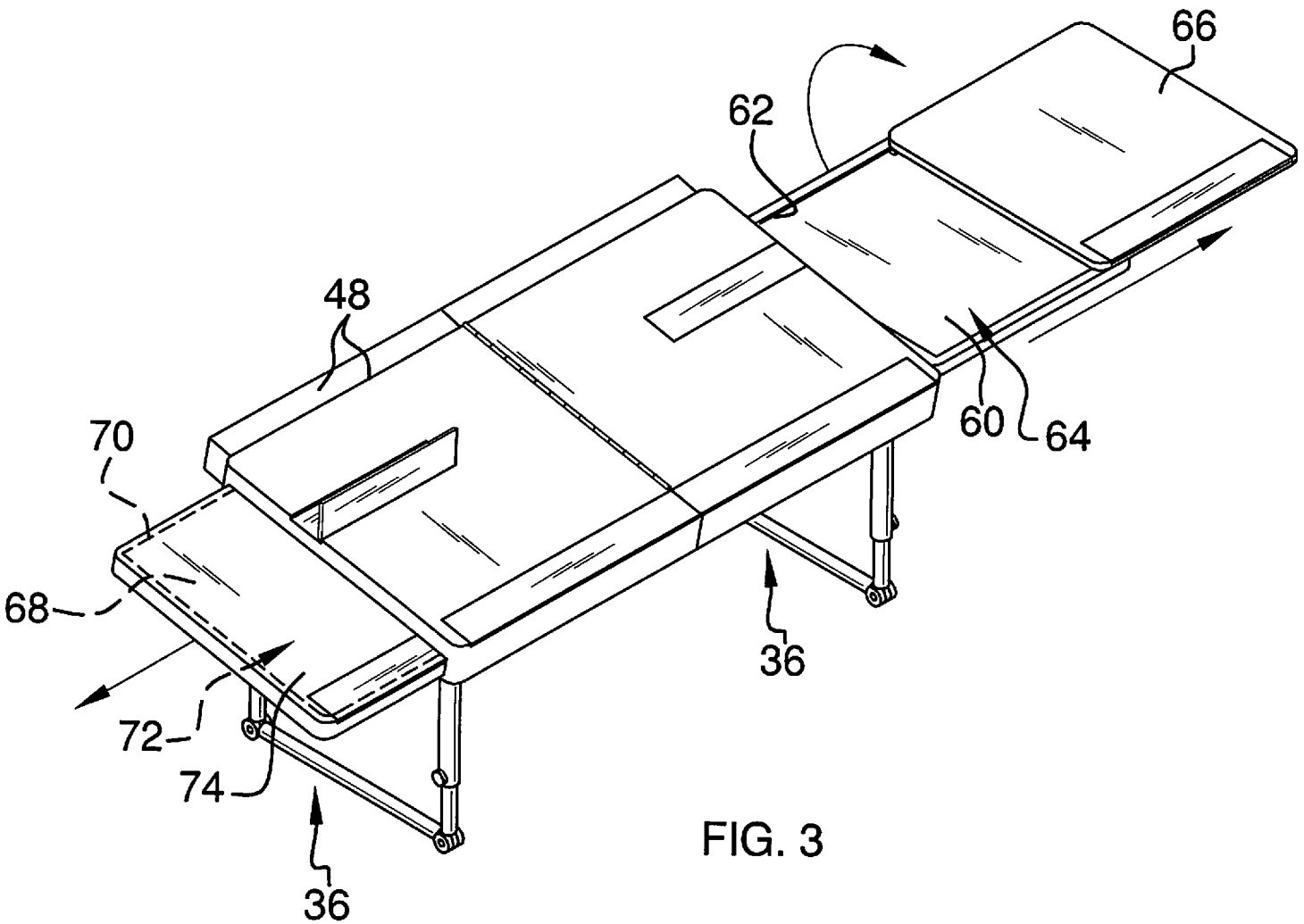
FIG. 3 is a top front side perspective view of an embodiment of the disclosure.
Figure 4:
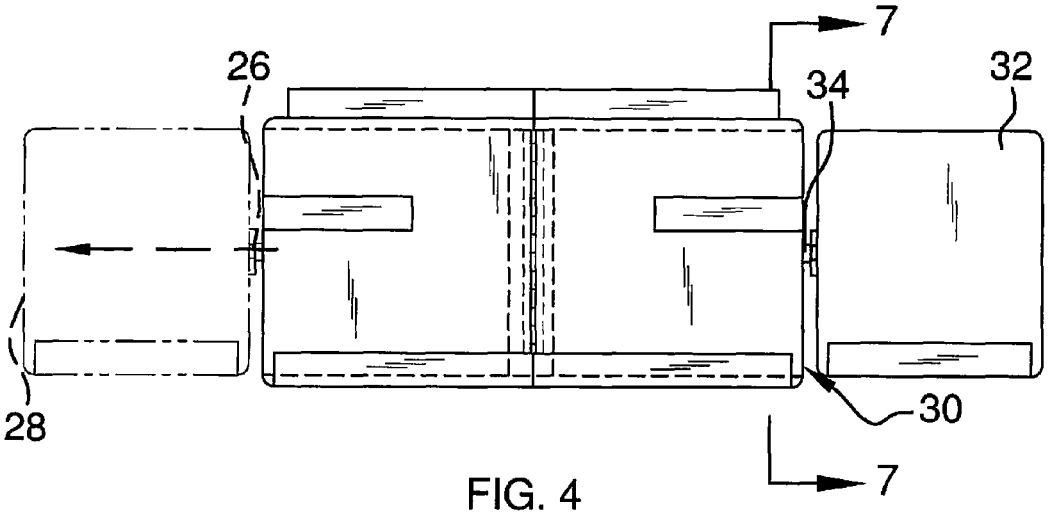
FIG. 4 is a top view of an embodiment of the disclosure.
Figure 5:
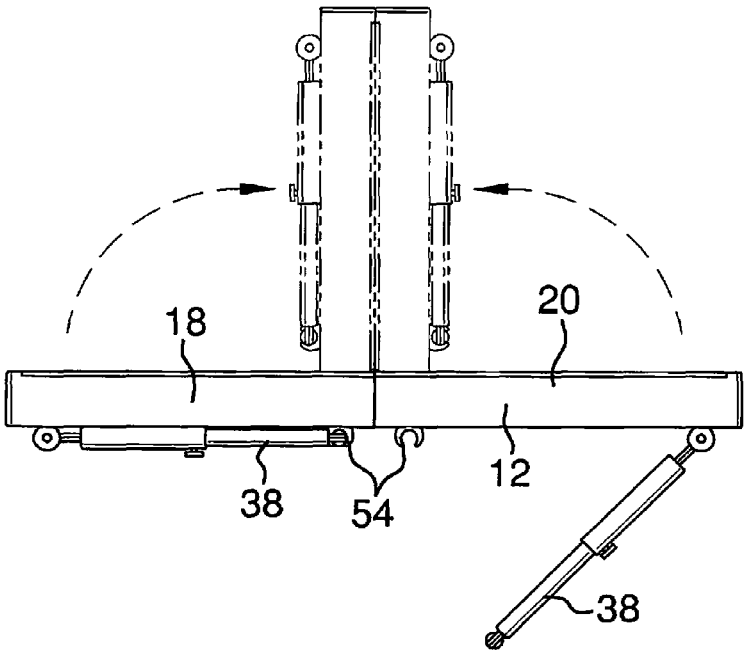
FIG. 5 is a front view of an embodiment of the disclosure.
Figure 6:
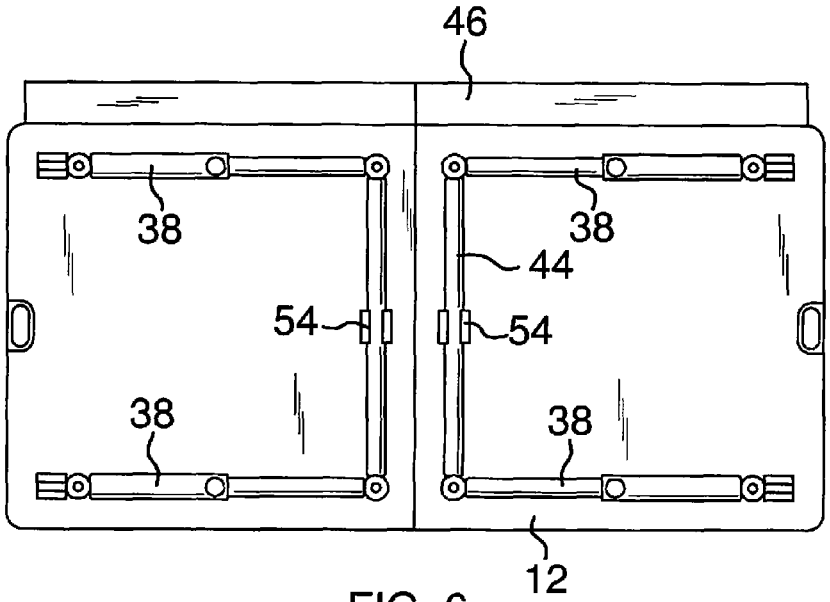
FIG. 6 is a bottom view of an embodiment of the disclosure.
Figure 7:
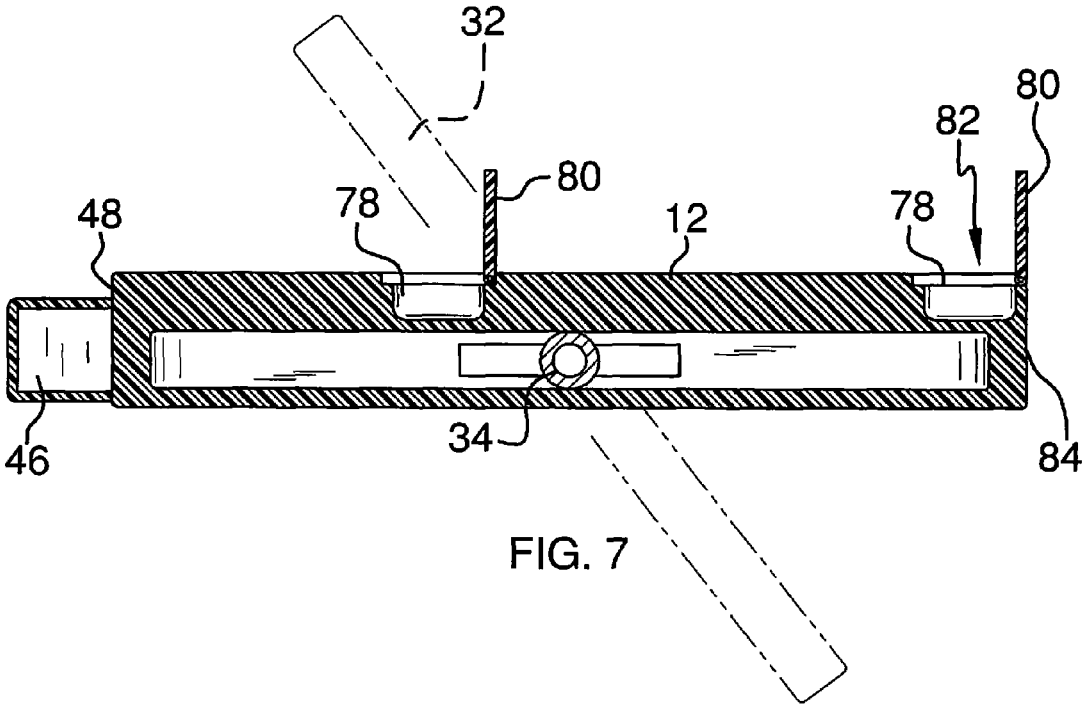
FIG. 7 is a cross-sectional view of an embodiment of the disclosure taken along line 7-7 of FIG. 4.
Figure 8:
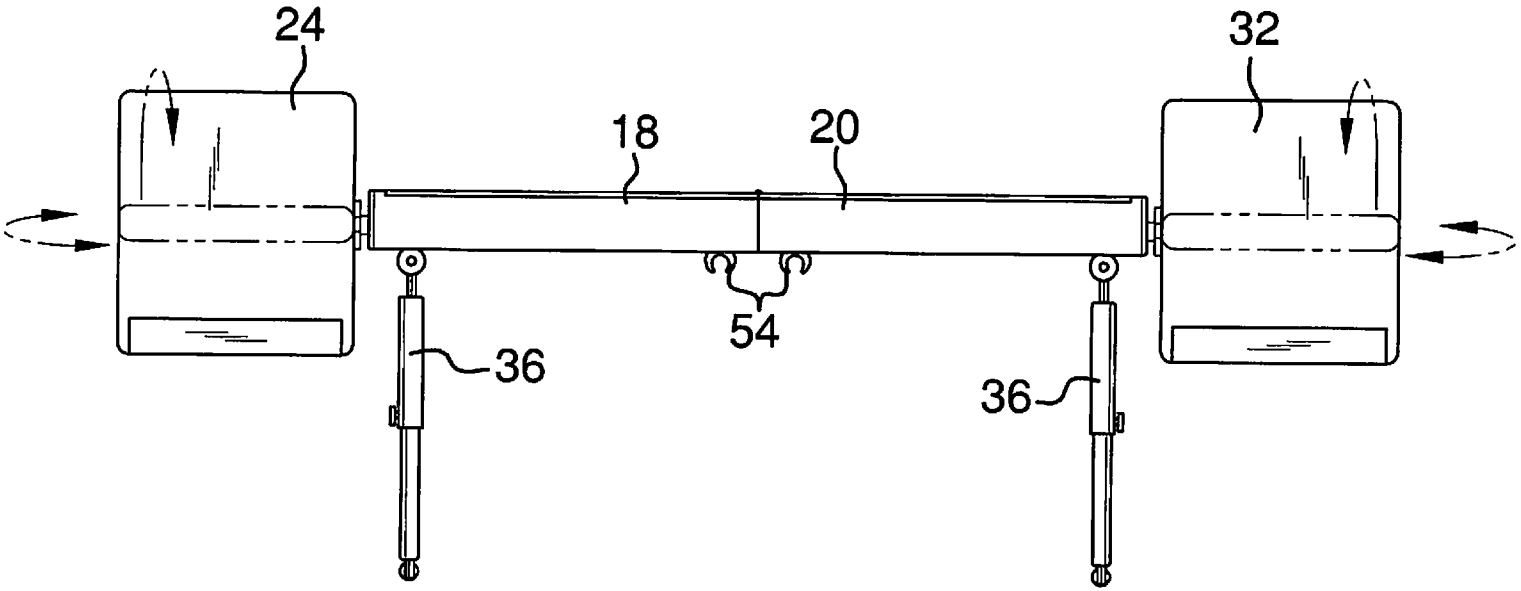
FIG. 8 is a front view of an embodiment of the disclosure.
Figure 9:
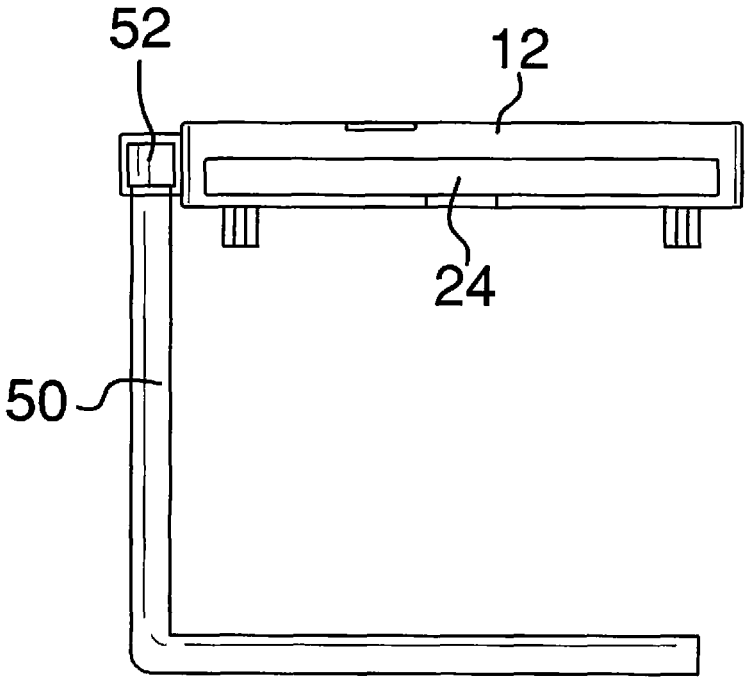
FIG. 9 is a side view of an embodiment of the disclosure.

With reference now to the drawings, and in particular to FIGS. 1 through 9 thereof, a new table device embodying the principles and concepts of an embodiment of the disclosure and generally designated by the reference numeral 10 will be described.

As best illustrated in FIGS. 1 through 9, the adjustable table assembly 10 generally comprises a medial panel 12 having a first side 14 and a second side 16. The medial panel 12 may also have a first section 18 and a second section 20 hingedly coupled together such that the medial panel 12 can be folding into a compact position. A first slot 22 extends into the first side 14 of the medial panel 12. A first side panel 24 is coupled to the medial panel 12 and slidably inserted into the first slot 22 in a conventional manner whereby the first side panel 24 is selectively extendable from the medial panel 12 forming a second usable table surface adjacent to the medial panel. The first side panel 24 includes a bottom wall 68 and a perimeter wall 70 defining a first side compartment 72. A first side cover 74 is slidably coupled to the first side panel 24 to selectively cover the first side compartment 72. A first side pivot hinge 26 is coupled between the medial panel 12 and the first side panel 24 whereby the first side panel 24 is pivotable relative to the medial panel 12. A conventional pivoting mechanism such as a ball hinge may be used to permit pivoting of the first side panel 24 such that a distal edge 28 of the first side panel 24 relative to the medial panel 12 pivots upwardly relative to the medial panel 12. The first side pivot hinge 26 also permits pivoting of the first side panel 24 in a plane around the first side pivot hinge 26 coplanar to the medial panel 12. Conventional locking mechanisms may be incorporated to hold the first side panel 26 in a stable position during use. The medial panel 12 may also include a plurality of compartments 78 each pivotally covered by a lid 80. The lids 80 of a pair of bottom compartments 82 may pivot into a transverse position relative to a forward edge 84 of the medial panel 12.

Similarly, a second side slot 30 extends into the second side 16 of the medial panel 12. A second side panel 32 is coupled to the medial panel 12 and slidably inserted into the second slot 30 whereby the second side panel 32 is selectively extendable from the medial panel 12. The second side panel 32 also includes a bottom wall 60 and a perimeter wall 62 defining a second side compartment 64. A second side cover 66 is slidably coupled to the second side panel 32 to selectively cover the second side compartment 64. A second side pivot hinge 34 is coupled between the medial panel 12 and the second side panel 32 whereby the second side panel 32 is pivotable relative to the medial panel 12 in the same manner as the first side panel 26.

A plurality of legs 36 is coupled to the medial panel 12. The legs 36 are pivotally coupled to the medial panel 12. Each of the legs 36 has a pair of outer portions 38 having upper ends 40 and lower ends 42. The upper ends 40 of each of the legs 36 is coupled to the medial panel 12. Each of the legs 36 has a cross portion 44 coupled to and extending between the lower ends 42 of the leg 36. Each of the outer portions 38 of the legs 36 may be telescopic. The lower ends 42 of each outer portion 38 is pivotally coupled to the cross portion 44 whereby an angle at which the legs 36 support the medial panel 12 is adjustable while the cross portion 44 remains beneath the medial panel 12. A plurality of clips 54 is coupled to the medial panel 12. The clips 54 selectively engage the legs 36 whereby the clips 54 hold the legs 36 in a collapsed position against the medial panel 12.

A hollow tube 46 may be coupled to and extend along a back side 48 of the medial panel 12. The hollow tube 46 has a rectangular cross-sectional shape or other polygonal shape to prevent pivoting of the medial panel 12 relative to a stand 50 having a bar 52 insertable into the hollow tube 46. Thus, the stand 50 is configured for supporting the medial panel 12 when the bar 52 is inserted into the hollow tube 46.

In use, the medial panel 12 is supported on either the legs 36 or the stand 50. The medial panel 12 is used as a main table surface while the first side panel 24 and second side panel 32 may be extended from the medial panel 12 and utilized as additional table surfaces. The first and second side panels 24, 32 may be pivoted into a desired position. The legs 36 may also be adjusted to position the medial panel 12 at a desired orientation.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An adjustable table assembly comprising:

a medial panel, said medial panel having a first side and a second side;

a first slot extending into;

a first side panel coupled to said medial panel, said first side panel being slidably inserted into said first slot whereby said first side panel is selectively extendable from said medial panel;

a first side pivot hinge coupled between said medial panel and said first side panel whereby said first side panel is pivotable relative to said medial panel;

a plurality of legs coupled to said medial panel said legs being pivotally coupled to said medial panel; each of said legs having a pair of outer portions having upper ends and lower ends, said upper ends of each of said legs being coupled to said medial panel; each of said legs having a cross portion coupled to and extending between said lower ends of said leg; each of said outer portions of said legs being telescopic; and said lower ends of each said outer portion being pivotally coupled to said cross portion whereby an angle at which said legs support said medial panel is adjustable.

2. The assembly of claim 1, further comprising:

a second side slot extending into said second side of said medial panel, said second side slot extending between said first and second lateral sides of said medial panel such that a first edge of said second side slot is positioned proximate said first lateral side and a second edge of said second side slot is positioned proximate said second lateral side;

a second side panel coupled to said medial panel, said second side panel being slidably inserted into said second slot whereby said second side panel is selectively extendable from said medial panel; and a second side pivot hinge coupled between said medial panel and said second side panel whereby said second side panel is pivotable relative to said medial panel.

3. The assembly of claim 1, further comprising:

a hollow tube coupled to and extending along a back side of said medial panel; and a stand having a bar insertable into said hollow tube whereby said stand is configured for supporting said medial panel when said bar is inserted into said hollow tube.

4. The assembly of claim 3, further including said hollow tube having a rectangular cross-sectional shape.

5. The assembly of claim 1, further including said medial panel having a first section and a second section, said first section being hingedly coupled to said second section.

6. The assembly of claim 1, further including clips coupled to said medial panel, said clips selectively engaging said legs whereby said clips hold said legs in a collapsed position.

7. An adjustable table assembly comprising:

a medial panel, said medial panel having a first side and a second side, said medial panel having a first section and a second section, said first section being hingedly coupled to said second section;

a first slot extending into said first side of said medial panel, said first slot extending between first and second lateral sides of said medial panel such that a first edge of said first slot is positioned proximate said first lateral side and a second edge of said first slot is positioned proximate said second lateral side;

a first side panel coupled to said medial panel, said first side panel being slidably inserted into said first slot whereby said first side panel is selectively extendable from said medial panel, said first side panel having a bottom wall and a perimeter wall forming a first side compartment;

a first side pivot hinge coupled between said medial panel and said first side panel whereby said first side panel is pivotable relative to said medial panel;

a first side cover slidably coupled to said first side panel to selectively cover said first side panel;

a second side slot extending into said second side of said medial panel, said second side slot extending between said first and second lateral sides of said medial panel such that a first edge of said second side slot is positioned proximate said first lateral side and a second edge of said second side slot is positioned proximate said second lateral side;

a second side panel coupled to said medial panel, said second side panel being slidably inserted into said second slot whereby said second side panel is selectively extendable from said medial panel, said second side panel having a bottom wall and perimeter wall defining a second side compartment;

a second side cover slidably coupled to said second side panel to selectively cover said second side compartment;

a second side pivot hinge coupled between said medial panel and said second side panel whereby said second side panel is pivotable relative to said medial panel;

a pair of compartments extending into a top surface of said medial panel;

a pair of lids, each of said lids being pivotally coupled to an associated one of said compartments to selectively cover said associated compartments;

a plurality of legs coupled to said medial panel, said legs being pivotally coupled to said medial panel, each of said legs having a pair of outer portions having upper ends and lower ends, said upper ends of each of said legs being coupled to said medial panel, each of said legs having a cross portion coupled to and extending between said lower ends of said leg, each of said outer portions of said legs being telescopic, said lower ends of each said outer portion being pivotally coupled to said cross portion whereby an angle at which said legs support said medial panel is adjustable;

a hollow tube coupled to and extending along a back side of said medial panel, said hollow tube having a rectangular cross-sectional shape;

a stand having a bar insertable into said hollow tube whereby said stand is configured for supporting said medial panel when said bar is inserted into said hollow tube; and a plurality of clips coupled to said medial panel, said clips selectively engaging said legs whereby said clips hold said legs in a collapsed position.

* * * * *